US005272773A

United States Patent [19]

Kamata

[11] Patent Number: 5,272,773

[45] Date of Patent: Dec. 28, 1993

[54] HELMET

[75] Inventor: Eitaro Kamata, Tokyo, Japan

[73] Assignee: Shoei Kako Kabushiki Kaisha, Tokyo, Japan

[21] Appl. No.: 721,801

[22] Filed: Jun. 26, 1991

[30] Foreign Application Priority Data

Jan. 29, 1991 [JP] Japan ..... 3-002422[U]

[51] Int. Cl.[5] ..... A42B 7/00

[52] U.S. Cl. ..... 2/421; 2/425

[58] Field of Search ..... 2/410, 411, 414, 421, 2/422, 424, 425

[56] References Cited

U.S. PATENT DOCUMENTS

| | | | |
|---|---|---|---|
| 4,044,400 | 8/1977 | Lewicki et al. | 2/421 |
| 4,434,514 | 3/1984 | Sundahl et al. | 2/425 |
| 4,461,044 | 7/1984 | Reitermann et al. | 2/421 |
| 4,464,799 | 8/1984 | Nava | 2/421 |
| 4,653,123 | 3/1987 | Broersma | 2/425 |
| 4,901,373 | 2/1990 | Broersma | 2/421 |
| 4,903,348 | 2/1990 | Broersma | 2/421 |
| 4,996,724 | 3/1991 | Dextrase | 2/411 |
| 5,044,016 | 9/1991 | Coombs | 2/421 |

FOREIGN PATENT DOCUMENTS

| | | | |
|---|---|---|---|
| 52068 | 5/1982 | European Pat. Off. | 2/421 |
| 0126027 | 11/1984 | European Pat. Off. . | |
| 0217996 | 4/1987 | European Pat. Off. . | |
| 2177893 | 2/1987 | United Kingdom | 2/411 |

*Primary Examiner*—Clifford D. Crowder
*Assistant Examiner*—Michael A. Neas
*Attorney, Agent, or Firm*—Armstrong, Westerman, Hattori, McLeland & Naughton

[57] ABSTRACT

Support portions are integrally molded on an inner surface of a helmet shell made of synthetic resin for supporting folded-back portions of a chin belt, and belt holes, through which the chin belt is passed, are provided in a shock-absorbing liner in correspondence to the support portions. Thus, the chin belt can be simply attached to a cap body without use of any separate support plate and rivet, thereby providing a cost reduction and a better external appearance.

3 Claims, 5 Drawing Sheets

HELMET

BACKGROUND OF THE INVENTION

1. Field of the Invention

The field of the present invention is helmets which are relatively lightweight and used by a cyclist or the like, and more particularly, improvements in helmets of a type having a chin belt attached to a cap body which includes a shock-absorbing liner fitted inside a shell made of synthetic resin.

2. Description of the Prior Art

To attach a chin belt to the cap body in such a conventional helmet, a support plate has been secured to a shell of the cap body by a rivet and a folded-back top end portion of the chin belt is supported on the support plate (for example, see Japanese Utility Model Publication Kokoku No. 31,068/79).

In such a mounting structure of the chin belt, since many parts are required such as the support plate and the rivet and since rivetting equipment must be used, it is difficult to reduce the manufacturing cost. In addition, an enlarged head of the rivet is exposed on an outer surface of the shell and this injures the appearance of lightweight to be sensed from the cap body.

SUMMARY OF THE INVENTION

Accordingly, it is an object of the present invention to provide a helmet of the type described above, in which the chin belt can be simply attached to the cap body, leading to a lower manufacturing cost and, moreover, such mounted portion cannot injure the appearance of the cap body.

To achieve the above object, in a first aspect of the present invention, there is provided a helmet comprising a cap body including a shock-absorbing liner fitted inside a shell made of synthetic resin and a chin belt attached to the cap body, wherein a support portion is integrally formed on an inner surface of the shell for supporting a folded-back portion of the chin belt.

According to the first aspect of the present invention, the folded-back portion of the chin belt can be mounted directly to the shell and, therefore, it is unnecessary to use any support plate and any rivet as in the prior art and it is possible to provide a reduction in manufacturing cost by simplification of the structure and the mounting operation. Moreover, such mounted portion does not appear on an outer surface of the shell and hence, the appearance of lightweight of the cap body is not injured in anyway.

In addition, in a second aspect of the present invention, the shock-absorbing liner is provided with a belt hole, through which the chin belt passes in correspondence to the support portion of the shell.

According to the second aspect of the present invention, the chin belt passing through the belt hole in the shock-absorbing liner guides the fitting of the shock-absorbing liner, into the shell so that such fitting operation can be easily and properly conducted.

In addition to the second aspect, a third aspect of the present invention is that a peripehral edge of a lower end of the shell is formed into a wave shape and a wave-shaped upwardly-directed step is formed on an outer surface of the shock-absorbing liner to engage the peripheral edge of the lower end of the shell.

According to the third aspect of the present invention, a position in which the shock-absorbing liner is fitted into the shell is defined by engagement of the lower edge of the shell with the upwardly-directed step of the shock-absorbing liner. Even if the adhesive force between both the shell and the shock-absorbing liner is weak it is possible to prevent any separation and slipping of the shell and the shock-absorbing liner from each other at impact.

The above and other objects, features and advantages of the invention will become apparent from a reading of the following description of the preferred embodiment, taken in conjunction with the accompanying drawings.

BRIEF DESCRIPTION OF THE DRAWINGS

Drawings illustrate one embodiment of the present invention applied to a helmet for use by a cyclist, wherein.

DESCRIPTION OF THE PREFERRED EMBODIMENT

The present invention will now be described by way of one embodiment in connection with the accompanying drawings.

Figure 1:
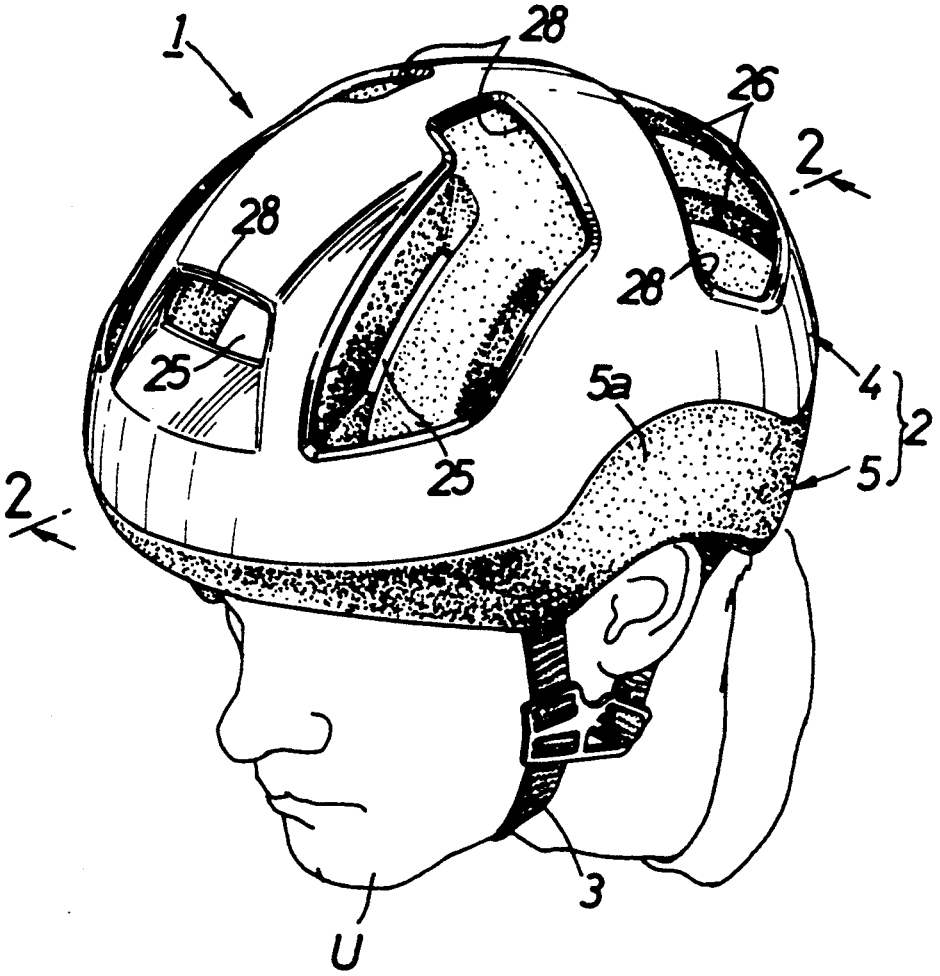
FIG. 1 is a perspective view of the entire helmet.
Figure 2:
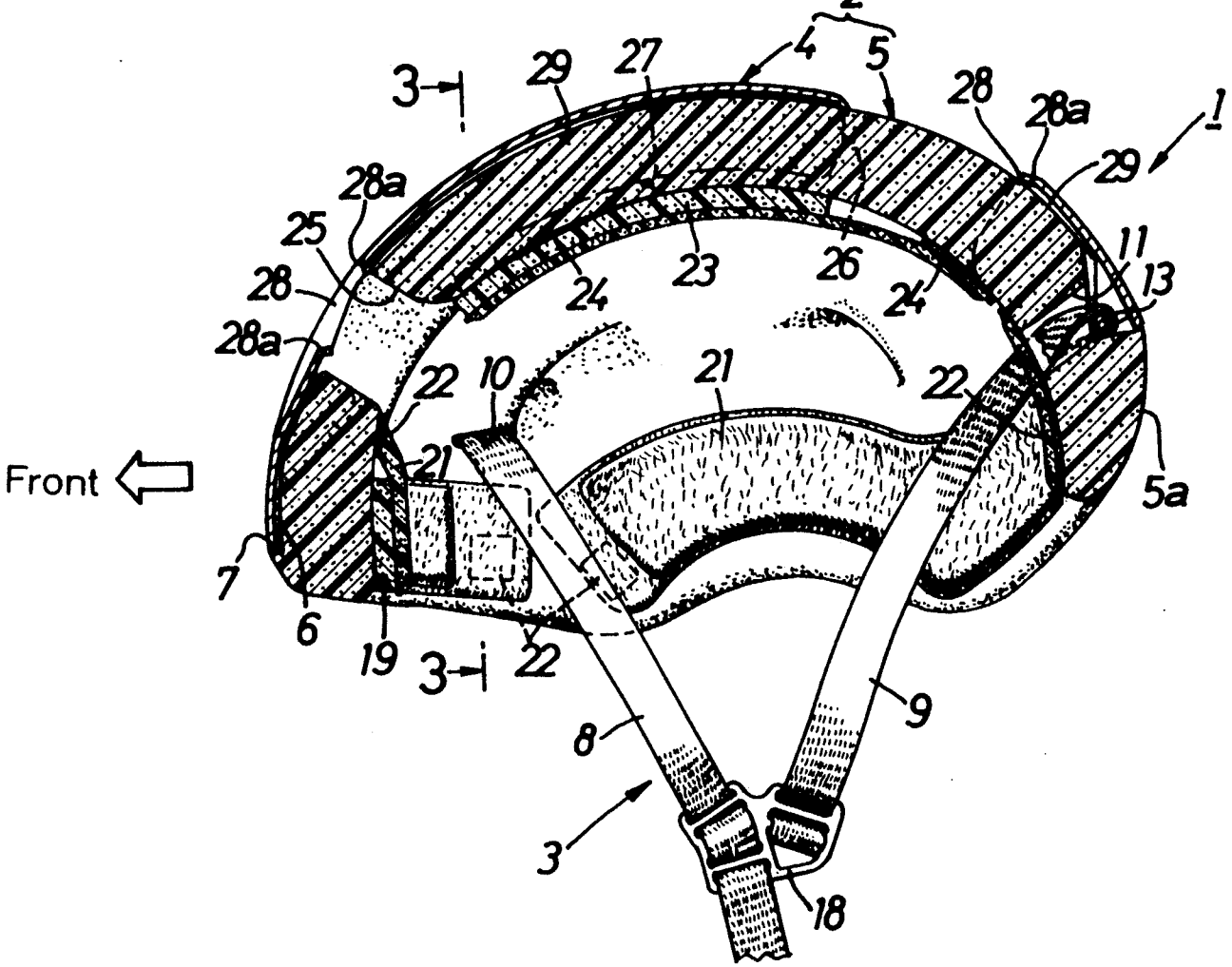
FIG. 2 is a sectional view taken along a line 2—2 in FIG. 1.
Figure 3:
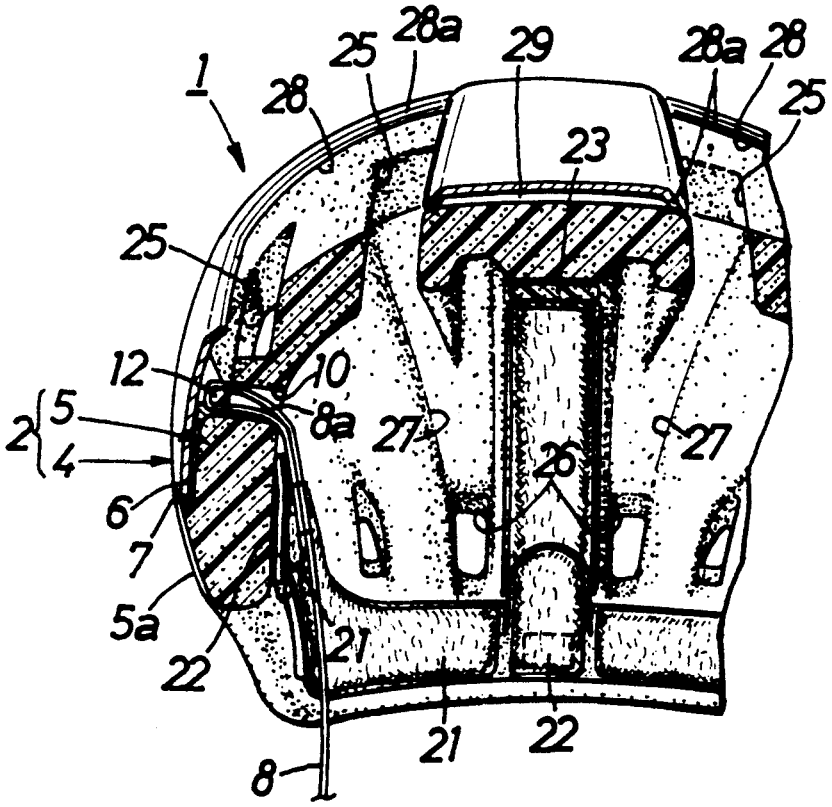
FIG. 3 is a sectional view taken along a line 3—3 in FIG. 2.
Figure 4:
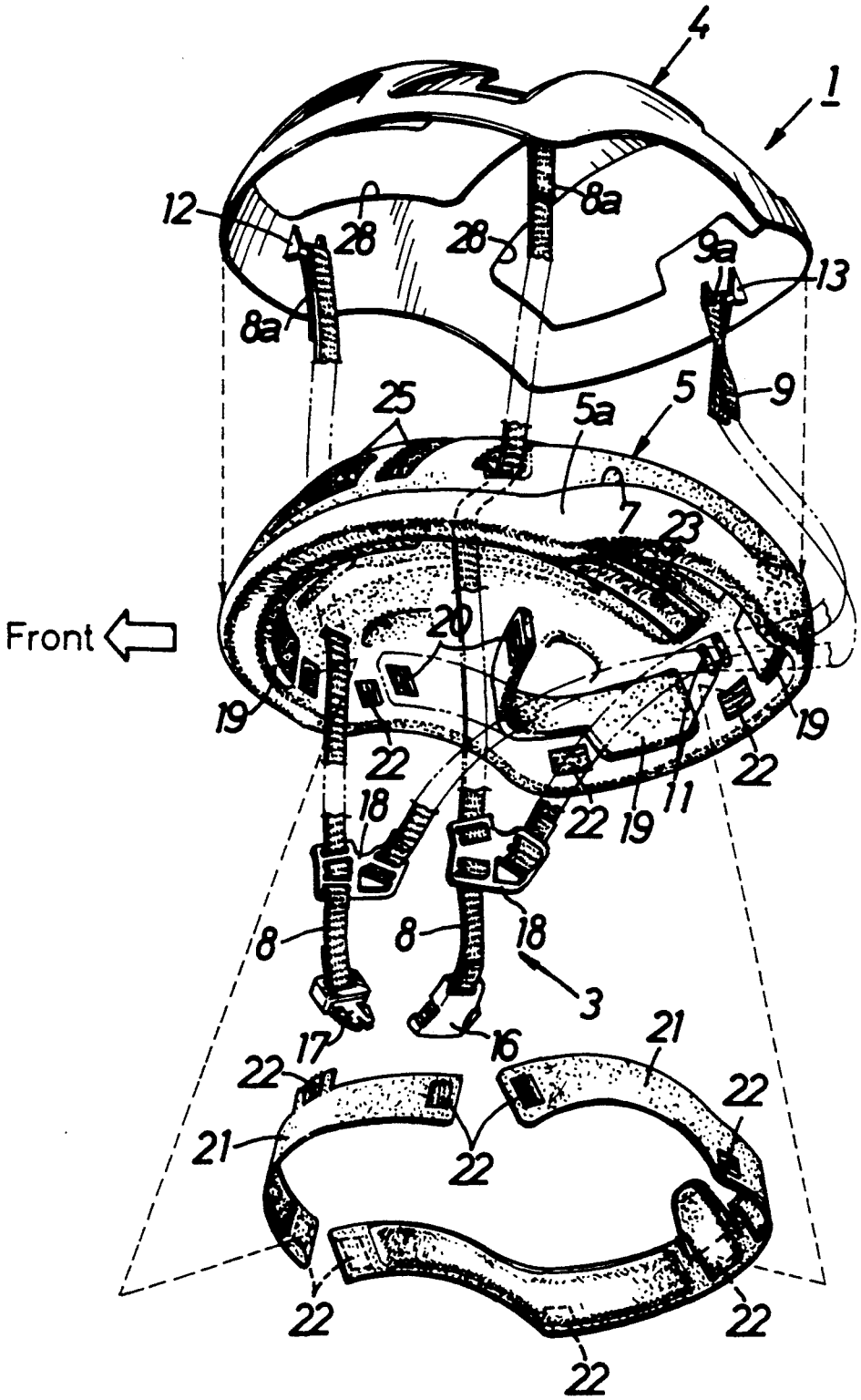
FIG. 4 is an exploded perspective view of the helmet.

Referring first to FIG. 1, a cap body 2 of a helmet is put, for example, on a head of a cyclist U, with a chin belt 3 put around a chin of the cyclist U.

Referring to FIGS. 1 to 4; the cap body 2 includes essentially a shock-absorbing liner 5 made of foamed polystyrene, and a shell 4 made of synthetic resin. The shell 4 is fitted over an outer surface of the shock-absorbing liner 5, excluding an annular exposed region 5*a* at a peripheral edge of the lower end of the liner 5. The shock-absorbing liner 5 and the shell 4 are bonded to each other at a peripheral edge of the lower end of the shell 4 through a double faced adhesive tape 6.

The peripheral edge of the lower end of the shell 4 is formed into a wave shape and correspondingly, a wave-shaped upwardly-directed step 7 is formed on an outer surface of the shock-absorbing liner 5 between a region covered by the shell 4 and the annular exposed region 5*a*, so that an outer surface of the shell 4 is continuous to the exposed region 5*a* of the shock-absorbing liner 5 by engagement of such peripheral edge of the lower end with the upwardly-directed step 7.

The chin belt 3 is comprised of a pair of left and right front belt elements 8, and a single rear belt element 9 folded back at its central portion. These belt elements pass through belt holes 10 and 11 in the shock-absorbing liner 5 and attached to the shell 4 in the following manner.

Support portions 12 and 13 are integrally made by molding on an inner surface of the shell 4 at three points: left and right side points and a rear point, respectively. Upper end folded-back portions 8*a* of the left and right front belt elements 8 are supported by the left and right support portions 12, and the central folded-back portion 9*a* of the rear belt element 9 is supported by the rear support portion 13.

Figure 5:
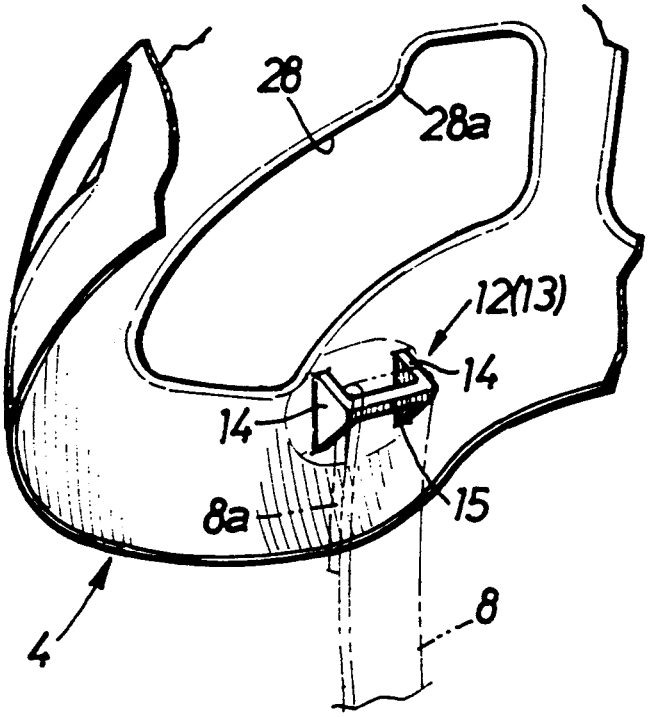
FIG. 5 is an enlarged view of an essential portion of the helmet.

As is apparent from FIG. 5, each of the support portions 12 and 13 is comprised of a pair of stays 14 projecting from the inner surface of the shell 4 and opposed to each other, and a support bar 15 interconnecting tip ends of the stays 14. The folded-back portions 8a and 9a of the belt elements are supported by the corresponding support bars 15.

A buckle 16 is attached to a lower end of the lefthand front belt element 8, and a tongue 17 is attached to a lower end of the righthand front belt element 8, so that the front belt elements 8 are connected to each other by engagement of the buckle 16 with the tongue 17. An adjusting plate 18 is vertically adjustably attached to a middle portion of each of the left and right front belt elements 8, and each of left and right opposite ends of the rear belt element 9 is connected to corresponding one of the adjusting plates 18 for adjustment of the length of the rear belt element 9.

A plurality of band-like fit pads 19 are mounted on an inner peripheral surface of the lower end of the shock-absorbing liner 5 at circumferentially spaced apart distances through face fasteners 20, and a plurality of band-like sweat-hold members 21 are mounted on the inner peripheral surface of the liner 5 likwise through a magic tape 22 to cover the fit pads 19. The fit pad 19 is made of urethane foam rich in softness, and the sweat-hold member 21 is made of moisture-absorbing material.

Further, a band-like top pad 23 is mounted on an inner surface of a top portion of the shock-absorbing liner 5 through a magic tape 24 to extend longitudinally.

The shock-absorbing liner 5 has a plurality of air inlet holes 25 provided in a front wall thereof, and a plurality of air outlet holes 26 provided in a rear wall thereof. Air channels 27 are provided in the inner surface of the shock-absorbing liner 5 for permitting the communication between the air inlet and outlet holes 25 and 26.

A plurality of openings 28 are provided in the shell 4 to prevent the air inlet and outlet holes 25 and 26 from being occluded by the shell 4. The openings 28 are formed into a size sufficent to satisfy both of a reduction in weight and a retention of strength of the shell 4. Each of the openings 28 has an inner peripheral edge formed as a bent edge 28a bent inwardly of the shell 4, so that a buffer void 29 is defined anywhere between the shell 4 and the liner 5 by abutment of each of the bent edges 28a against the outer surface of the shock-absorbing liner 5.

The operation of this embodiment will be described below.

In assembling the helmet 1, the left and right front belt elements 8 are first passed through the left and right support portions 12 and then, the folded-back portions 8a are sewed. The rear belt element 9 is also passed through the rear support portion 13 of the shell 4, so that the central folded-back portion 9a is supported. Then, the left and right front belt elements 8 are inserted through the left and right belt holes 10 in the shock-absorbing liner 5 from the above, and the rear belt element 9 is likewise inserted through the rear belt hole 11 from the above. Thereafter, the shock-absorbing liner 5 is put into the shell 4 while tensioning these belt elements 8 and 9, The shock-absorbing liner 5 is guided by the belt elements 8 and 9 and fitted into the shell 4 at a predetermined fitted location at which the peripheral edge of the lower end of the shell 4 engages the upwardly-directed step 7 of the shock-absorbing liner 5. At the same time, they are bonded to each other by the double-faced adhesive tape 6 previously adhered to the outer peripheral surface of the liner 5. Then, the buckle 16, the tongue 17, the adjusting plates 18 and the like are attached to the front and rear belt elements 8 and 9, respectively.

When using the helmet, a cyclist U wears the cap body 2 and fastens the chin belt 3. The shock-absorbing liner 5 is tightly held between a head of the cyclist U and shell 4 by the chin belt 3. Moreover, even if the adhesive force of the double-faced adhesive tape 6 bonding the shell 4 and-the shock-absorbing liner 5 is relatively weak, it is not feared that the shell 4 and the shock-absorbing liner 5 are slipped or separated from each other by an impact force from the outside, because the wave-shaped peripheral edge of the lower end of the shell 4 engages the wave-shaped upwardly-directed step 7 on the outer surface of the shock-absorbing liner 5.

The plurality of openings 28 in the shell 4 contribute to a reduction in weight of the shell 4. However such openings 28 do not serve to reduce the rigidity of the shell 4, since the peripheral edge of each opening 28 is formed as the bent edge 28a, and a reinforcing rib effect of such bent edge 28a insures the sufficient rigidity.

Furthermore, the bent edges 28a also contribute to the formation of the buffer voids 29 anywhere between the shell 4 and the shock-absorbing liner 5, as described above. The buffer voids 29 serve to permit a slight deformation of the shell 4 to abosrb a relatively small shock force.

During travelling on a bicycle, travel wind flows into the air inlet holes 25 in the shock-absorbing liner 5, through the air channels 27 and flows out from the air outlet holes 26. In this manner, the interior of the cap body 2 is ventilated. Such ventilation causes the head of the cyclist U to be cooled, while causing the moisture in the sweat-hold members 21 to be dried up.

Since the plurality of sweat-hold members 21 are mounted on the inner surface of the shock-absorbing liner 5 through the fasteners 22 separately from the fit pads 19, when the sweat-hold members 21 are stained with a sweat and the like, only the sweat-hold members 21 can be individually removed for cleaning and drying.

Also, since the fit pads 19 are mounted on the inner surface of the shock-absorbing liner 5 through the fasteners 20 separately from the sweat-hold members 21, only the fit pads 19 can be replaced by those having a different thickness so that the head size of the cap body 2 can be easily adjusted. In addition, since the fit pads 19 are covered with the sweat-hold members 21, which gives a comfortable feeling.

What is claimed is:

1. A helmet comprising a cap body including a shock-absorbing liner fitted inside a shell made of synthetic resin and a chin belt attached to the cap body, wherein a support portion is integrally formed on an inner surface of said shell for supporting a folded-back portion of said chin belt, wherein said shock-absorbing liner has a belt hole through which said chin belt is passed, in correspondence to said support portion of said shell to assist in fitting said liner to said shell, wherein a peripheral edge of a lower end of said shell is formed into a wave shape, while a wave-shaped upwardly-directed step with which the peripheral edge of said lower end of said shell is to be engaged is formed on an outer surface of said shock-absorbing liner, wherein said chin belt comprises a pair of left and right front belt elements, and a single rear belt element folded back at a central portion thereof, and said support portion is provided on an inner surface of said shell at each of three points: left and right side points and a rear point, folded-back portions at upper ends of said left and right front belt elements being supported by said support portions and said central portion of said rear belt element being supported by said support portion at said rear point, and wherein each of said left and right front belt elements has an adjusting plate attached to an intermediate portion thereof, each of left and right opposite ends of said rear belt element being connected to corresponding one of said adjusting plates for adjustment of the length of said rear belt element.

2. A helmet according to claim 1, wherein each of said support portions comprises a pair of stays projecting from said inner surface of said shell and opposed to each other, and a support bar interconnecting tip ends of said stays.

3. A helmet comprising a cap body including a shock-absorbing liner fitted inside a shell made of synthetic resin and a chin belt attached to the cap body, wherein a support portion is integrally formed on an inner surface of said shell for supporting a folded-back portion of said chin belt, and wherein said shock-absorbing liner has a belt hole through which said chin belt is passed, in correspondence to said support portion of said shell to assist in fitting said liner to said shell, wherein said chin belt comprises a pair of left and right front belt elements, and a single rear belt element folded back at a central portion thereof, and said support portion is provided on an inner surface of said shell at each of three points: left and right side points and a rear point, folded-back portions at upper ends of said left and right front belt elements being supported by said support portions and said central portion of said rear belt element being supported by said support portion at said rear point; and wherein each of said left and right front belt elements has an adjusting plate attached to an intermediate portion thereof, each of left and right opposite ends of said rear belt element being connected to corresponding one of said adjusting plates for adjustment of the length of said rear belt element.

* * * * *